US010850818B2

(12) United States Patent
Swift et al.

(10) Patent No.: US 10,850,818 B2
(45) Date of Patent: Dec. 1, 2020

(54) MARINE OUTBOARD MOTOR MOUNT FASTENER RETAINER

(71) Applicants: Jarrod Swift, Taylorsville, KY (US); Joshua T Honaker, Smithfield, KY (US); Bill Hurle, Louisville, KY (US)

(72) Inventors: Jarrod Swift, Taylorsville, KY (US); Joshua T Honaker, Smithfield, KY (US); Bill Hurle, Louisville, KY (US)

(73) Assignee: THE LEASH LLC, Taylorsville, KY (US)

( * ) Notice: Subject to any disclaimer, the term of this patent is extended or adjusted under 35 U.S.C. 154(b) by 69 days.

(21) Appl. No.: 15/851,739

(22) Filed: Dec. 21, 2017

(65) Prior Publication Data

US 2019/0193826 A1 Jun. 27, 2019

(51) Int. Cl.
*B63H 20/06* (2006.01)
*B63H 20/10* (2006.01)

(52) U.S. Cl.
CPC ..... *B63H 20/06* (2013.01); *B63H 20/10* (2013.01)

(58) Field of Classification Search
CPC ..... B63H 20/06; B63H 20/10
USPC .... 248/674, 300, 640, 641, 200; 440/53, 55, 440/58
See application file for complete search history.

(56) References Cited

U.S. PATENT DOCUMENTS 2,822,142 A * 2/1958 Collins ..... B63H 20/06 248/641
3,106,375 A * 10/1963 Donaldson ..... B63H 20/06 248/300
3,251,333 A * 5/1966 Smenner ..... B63H 21/265 248/300
4,518,141 A * 5/1985 Parkin ..... F21V 21/03 248/217.2
5,366,194 A * 11/1994 Finney ..... F16M 13/022 248/187.1
5,598,680 A * 2/1997 Wilhelmi ..... E04B 1/2608 52/715
5,685,511 A * 11/1997 Ghany ..... G09F 7/18 248/201
6,123,301 A * 9/2000 Schroeder ..... G01R 33/02 248/200
6,230,585 B1 * 5/2001 Bator ..... F16H 61/0009 137/343
6,241,206 B1 * 6/2001 Kam ..... H05K 7/1449 248/247
6,482,056 B1 * 11/2002 Schell-Tomczak .... B63H 20/06 248/641
8,979,056 B2 * 3/2015 Mayo ..... B64D 13/02 244/54

(Continued)

*Primary Examiner* — Terrell L McKinnon
*Assistant Examiner* — Michael McDuffie
(74) *Attorney, Agent, or Firm* — Steve Witters; Witters & Associates

(57) ABSTRACT

A marine outboard motor mount fastener retainer, system, and method are presently disclosed. The fastener retainer has a first end portion configured to be held about a first motor mount fastener and a second end portion configured to be held about a second motor mount fastener. An extension extends from the first end portion of the motor mount fastener retainer to the second end portion of the motor mount fastener retainer. The extension is configured to hold the first and the second end portions of the retainer and to prevent rotation of the first and the second motor mount fasteners.

16 Claims, 6 Drawing Sheets

(56) References Cited

U.S. PATENT DOCUMENTS

| | | | | |
|---|---|---|---|---|
| 9,834,292 | B1 * | 12/2017 | Drozdowski | B63H 20/06 |
| 2007/0262222 | A1 * | 11/2007 | Steigert | F01N 13/10<br>248/300 |

* cited by examiner

MARINE OUTBOARD MOTOR MOUNT FASTENER RETAINER

FIELD OF THE DISCLOSURE

This invention relates to marine engines and more particularly to devices for retaining marine outboard motor mount fasteners.

BACKGROUND

Small boats, such as bass boats and the like, can be provided with fairly large outboard motors which may reach speeds of up to about 100 miles per hour. Outboard motors may vibrate while running which may cause marine outboard motor mount fasteners to loosen. For example, an outboard motor may be held on the transom of a boat with fasteners. Each fastener may have a bolt extending through the transom, extension from the transom, or jack plate, and a nut tightened onto the bolt. Operation of the outboard motor may cause vibration which may in turn cause one or more of the nuts or bolts to loosen.

Outboard motors are often pivotally mounted on the transom of the boat with a motor mount or mounting bracket. The mounting bracket typically allows for rotation of the drive mechanism, particularly the propeller, above the surface of the water or above the ground for towing, launching and recovering the boat. Loosening of one or more of the marine outboard motor mount fasteners may cause the outboard motor to become dislodged from the transom. For example, striking an object in the water may cause the motor to become dislodged. One or more loosened motor mount fasteners may increase the likelihood that the motor may be separated from the transom. An outboard motor may violently rotate or flip, if an impact with an object in the water is severe enough.

SUMMARY

The present invention relates to a marine outboard motor mount fastener retainer. The presently disclosed fastener retainer is configured to minimize, or prevent, the loosening of motor mount bolts or nuts.

In one embodiment of the present disclosure, a marine outboard motor mount fastener retainer is provided. The fastener retainer comprises a first end portion configured to be held about a first motor mount fastener and a second end portion configured to be held about a second motor mount fastener. An extension extends from the first end portion of the retainer to the second end portion of the retainer. The extension is configured to hold the first and the second end portions of the retainer and to prevent rotation of the first motor mount fastener and the second motor mount fastener.

In another embodiment of the present disclosure, a marine outboard motor mount fastener retainer system is provided. The system comprises a first motor mount fastener retainer and a second motor mount fastener retainer. The first motor mount fastener retainer comprises a first end portion configured to be held about a first motor mount fastener and a second end portion configured to be held about a second motor mount fastener. An extension extends from the first end portion of the first retainer to the second end portion of the first retainer, the first extension being configured to hold the first and the second end portions of the first retainer and to prevent rotation of the first motor mount fastener and the second motor mount fastener. The second motor mount fastener retainer comprises a first end portion configured to be held about a third motor mount fastener and a second end portion configured to be held about a fourth motor mount fastener. A second extension extends from the first end portion of the second retainer to the second end portion of the second retainer, the second extension being configured to hold the first and the second end portions of the second retainer and to prevent rotation of the third motor mount fastener and the fourth motor mount fastener.

In a further embodiment of the present disclosure, a method of mounting a marine outboard motor onto a transom of a boat is provided. The method comprises the steps of: placing a motor mounting bracket onto a transom of a boat; extending a plurality of motor mount bolts through the transom, extension from the transom, or jack plate, and the mounting bracket; fastening a motor mount nut onto each of the motor mount bolts and securing the mounting bracket onto the transom, extension from the transom, or jack plate; placing a first end portion of a motor mount fastener retainer about one of the motor mount nuts or heads of the motor mount bolts; placing a second end portion of the motor mount fastener retainer about another one of the motor mount nuts or heads of the motor mount bolts; and securing the end portions of the motor mount fastener retainer about the motor mount nuts or heads of the motor mount bolts and thereby preventing rotation of the motor mount nuts or heads of the motor mount bolts having the motor mount fastener retainer secured thereabout.

BRIEF DESCRIPTIONS OF THE DRAWINGS

The foregoing and other features of this disclosure will become more fully apparent from the following description and appended claims, taken in conjunction with the accompanying drawings and examples. Understanding that these drawings depict only several embodiments in accordance with the disclosure and are, therefore, not to be considered limiting of its scope, the disclosure will be described with additional specificity and detail through use of the following figures, which are idealized, are not to scale and are intended to be merely illustrative of aspects of the present disclosure and non-limiting. In the drawings, like elements are depicted by like reference numerals. The drawings are briefly described as follows:

Figure 5A:
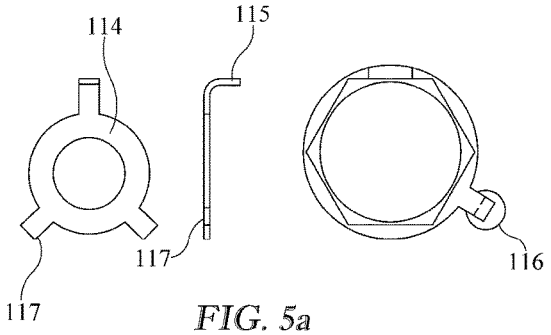
Figure 5C:
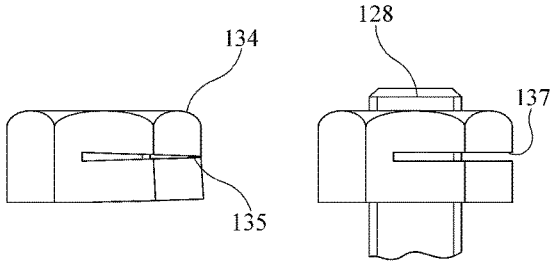
Figure 5B:
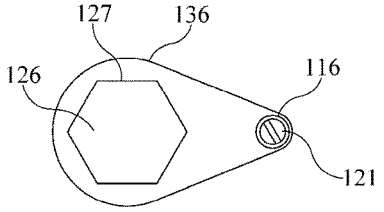
Figure 5D:
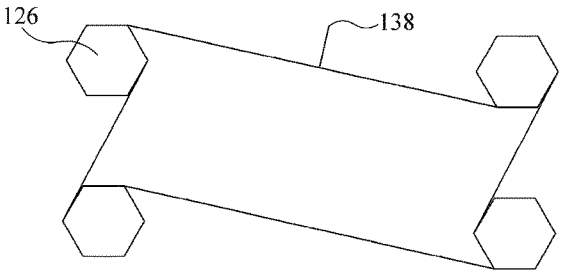
Figure 6A:
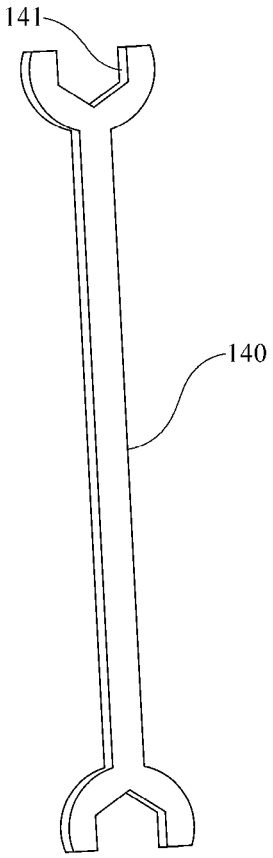
Figure 6B:
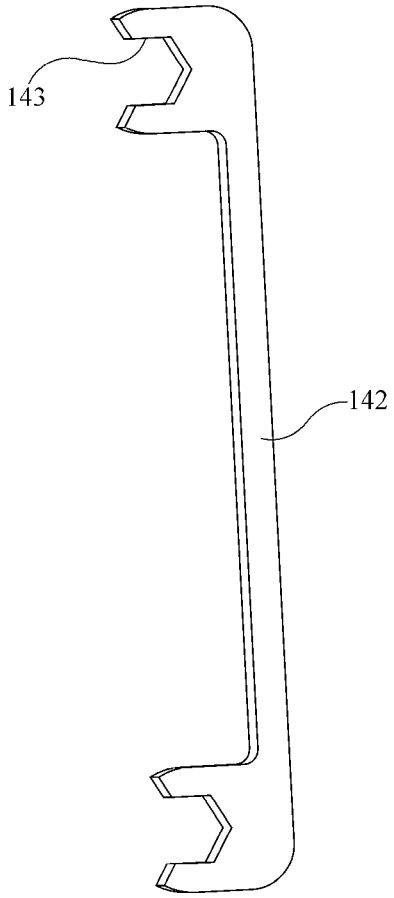

FIGS. 5*a*-5*d* show embodiments of nut stabilizers that may be a component part of the presently disclosed marine outboard motor mount fastener retainer system; and FIGS. 6*a* and 6*b* show alternative embodiments of the presently disclosed nut stabilizers or marine outboard motor mount fastener retainers.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

Figure 1:
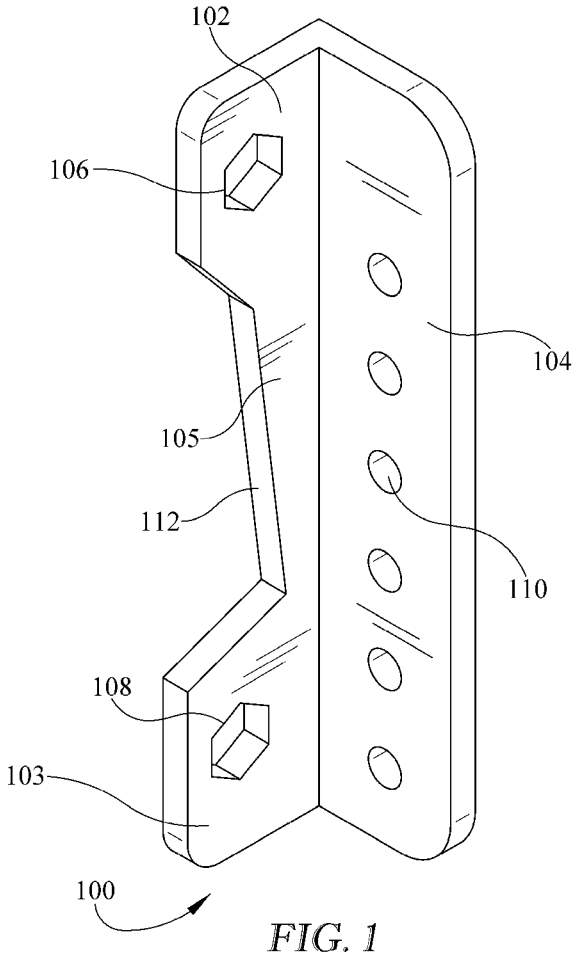
FIG. 1 is a perspective view of a marine outboard motor mount fastener retainer of the present disclosure.
Figure 2:
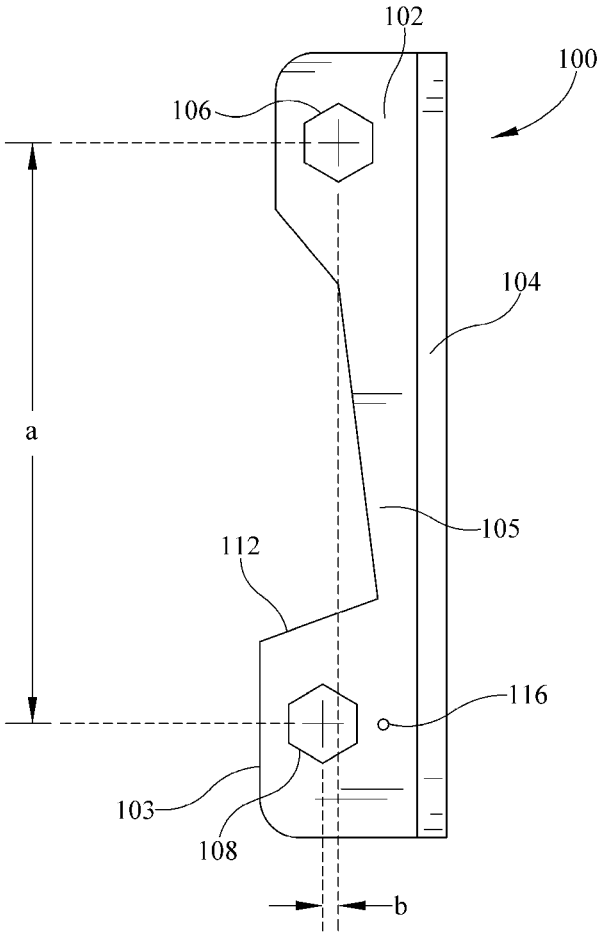
FIG. 2 is a front view of the marine outboard motor mount fastener retainer shown in FIG. 1.

FIGS. 1 and 2 show a perspective and front, respectively, view of an illustrative example of the presently disclosed marine outboard motor mount fastener retainer 100. Marine outboard motor mount fastener retainer 100 has a first end portion 102 configured to be held about a first motor mount fastener and a second end portion 103 configured to be held about a second motor mount fastener. Each motor mount fastener may have a motor mount bolt 128 and a motor mount nut 125, shown in FIG. 4. In at least one illustrative example, motor mount bolt 128 has about a ½ inch outer diameter.

Motor mount fastener retainer 100 has an extension 105 extending from first end portion 102 of retainer 100 to second end portion 103 of retainer 100. Extension 105 may be configured to hold first and second end portions, 102 and 103, of retainer 100 and to prevent rotation of the first motor mount fastener and the second motor mount fastener. For example, a first motor mount fastener receiver 106 may be configured to receive and prevent rotation of a first motor mount fastener and a second motor mount fastener receiver 108 may be configured to receive and prevent rotation of a second motor mount fastener.

In at least one embodiment of the presently disclosed marine outboard motor mount fastener retainer 100, extension 105 may have a nonlinear or angular wall 112. For example, wall 112 may have a configuration for fitting about or around outwardly extending portions of the outboard motor, outboard motor mount, transom, jack plate, or extension from the transom. It may be desired for wall 112 to avoid, or extend about, the outwardly extending portions that may cause spacing between end portions, 102 and 103, and the outboard motor mount to which marine outboard motor mount fastener retainer 100 is mounted.

Marine outboard motor mount fastener retainer 100 may have extension 105 with a portion configured to become gap spaced from a transom or a motor mounting bracket, upon retainer 100 being held onto, or about, motor mount nut 125. For example, marine outboard motor mount fastener retainer 100 may have a portion of extension 105 having at least one aperture 110. Extension 105 may be configured to have aperture(s) 110 spaced from a transom, extension from a transom, jack plate, or a motor mounting bracket, upon the retainer 100 being held onto, or about, motor mount fasteners such as motor mount nuts 125.

Marine outboard motor mount fastener retainer 100 may have extension 105 configured for attaching a boat accessory. For example, extension 105 may comprise a portion, such as flange 104, having at least one aperture 110 for attaching one or more boat accessory. For example, an outboard motor tether, depth finder/fish finder device, flag, trailer/boat straps, ski ropes, or other boat accessories may be attached to extension 105.

Marine outboard motor mount fastener retainer 100 may have portions configured for cooperating with a nut stabilizer. For example, retainer 100 may have an indention or aperture 116 that may be configured and disposed to cooperate with a nut stabilizer, such as nut stabilizer 114 or 136, shown in FIGS. 5*a* and 5*b*.

Figure 3:
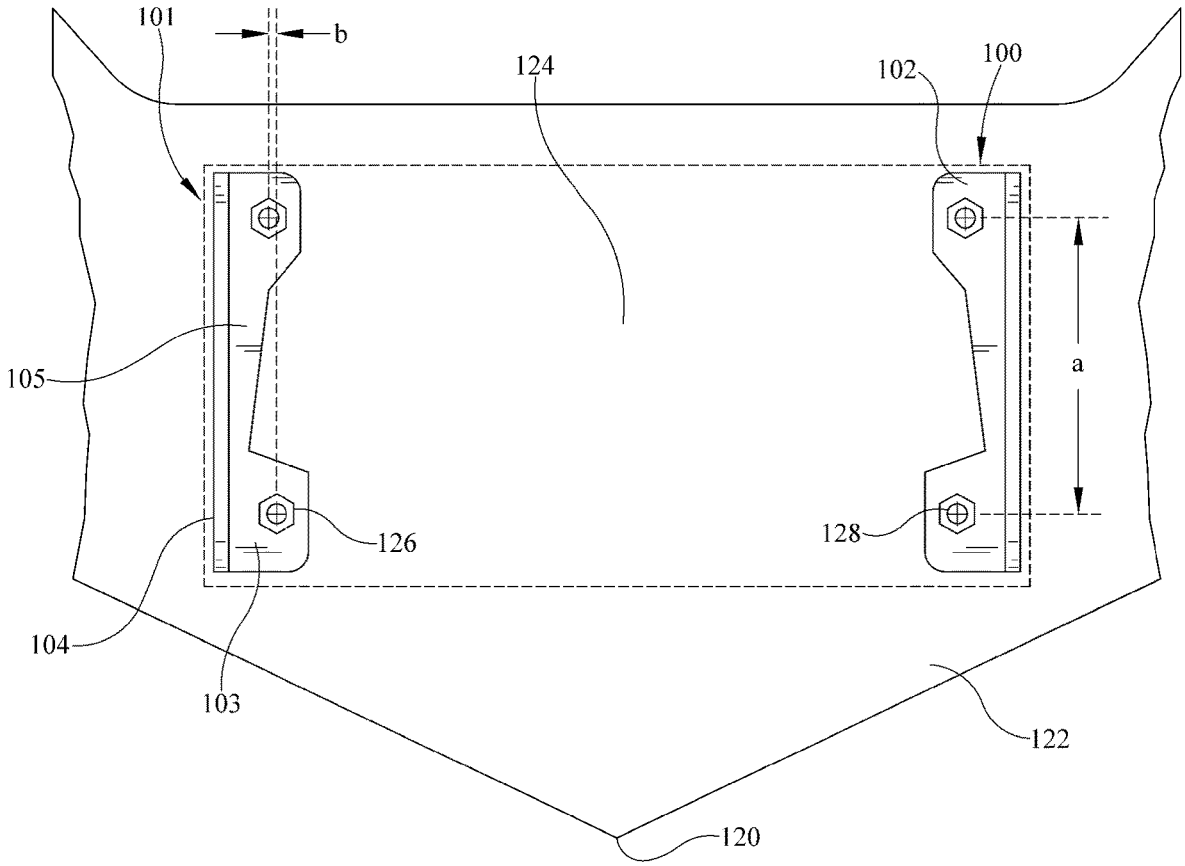
FIG. 3 shows the presently disclosed marine outboard motor mount fastener retainer system installed on the transom of a marine vessel.

FIG. 3 shows a marine outboard motor mount fastener retainer system of the present disclosure installed on the transom, jack plate, or an extension from the transom, 124, of a marine vessel, or boat, having hull 120. A marine outboard motor mount fastener retainer system may comprise a first motor mount fastener retainer 100 and a second motor mount fastener retainer 101. Second motor mount fastener retainer 101 may be configured as a mirror image of first motor mount fastener retainer 100 and may also have an upper portion 102, extension 105, and lower portion 103. An outboard motor may be held to a transom, jack plate, or an extension from the transom, 124, with motor mount fasteners. The outboard motor may have four motor mount fasteners and each motor mount fastener may have a motor mount nut 125 and motor mount bolt 128.

A transom, jack plate, or extension from a transom may have four apertures for mounting an outboard motor. A typical configuration of the apertures may have two upper apertures horizontally spaced about 12⅞ inches apart, on center. Two lower apertures may be horizontally spaced about 9⅞ inches apart. The lower apertures may be centrally aligned with the upper apertures and may be spaced about 8 inches below the upper apertures.

In at least one embodiment of the present disclosure, motor mount fastener retainer 100 may have first motor mount fastener receiver 106 vertically spaced from second motor mount fastener receiver 108 a distance of "a", on center. In at least one other embodiment of the present disclosure, motor mount fastener retainer 100 may be oriented onto a transom, jack plate, or extension from a transom, to have a horizontal offset between first motor mount fastener receiver 106 and second motor mount fastener receiver 108, a distance of "b", on center. Distance "a" may between about 6 inches and 10 inches, such as about 8 inches. Distance "b" may be between about ½ inches and 3 inches, such as about 1½ inches.

First motor mount fastener retainer 100 may have a first end portion 102 configured to be held about a first, or upper right, motor mount fastener or motor mount nut 125 or bolt 128 and a second end portion 103 configured to be held about a second motor mount fastener, or lower right, motor mount fastener or motor mount nut 125 or bolt 128. First motor mount fastener retainer 100 may have a first extension 105 extending from its first end portion 102 to its second end portion 103. First extension 105, of the first retainer 100, may be configured to hold first and second end portions 102 and 103, of first retainer 100, and to prevent rotation of first and second motor mount fasteners or motor mount nuts 125 or bolts 128.

Second motor mount fastener retainer 101 may be a mirror image of first motor mount fastener retainer 100 and have a first end portion 102 configured to be held about a third, or upper left, motor mount fastener or motor mount nut 125 or bolt 128 and a second end portion 103 configured to be held about a fourth motor mount fastener, or lower left, motor mount fastener or motor mount nut 125 or bolt 128. Second motor mount fastener retainer 101 may have a second extension 105 extending from its first end portion 102 to its second end portion 103. Second extension 105, of second retainer 101, may be configured to hold first and second end portions 102 and 103, of second retainer 101, and to prevent rotation of third and fourth motor mount fasteners or motor mount nuts 125 or bolts 128.

Motor mount fastener retainers 100 and 101 each have a motor mount fastener receiver 106 proximate each of their ends. The placement of first motor mount fastener receiver 106 about a first motor mount nut 125 or motor mount bolt 128 and the placement of second motor mount fastener receiver 108 about a second motor mount nut 125 or motor mount bolt 128, prohibits the rotation of the motor mount nuts 125 or bolts 128 about which the receivers are placed.

In at least one embodiment, the marine outboard motor mount fastener retainer system of system has a first, a second, a third, and a fourth motor mount fastener, each fastener comprise a bolt 128 and a nut 125, each of the end portions of the first motor mount fastener retainer 100 and each of the end portions of the second motor mount fastener retainer 101 are configured to be held onto one of the bolts 128 and nuts 125 of the motor mount fasteners. Motor mount retainer nuts 126 are fitted onto one of the motor mount bolts 128 and each holds one of the end portions of one of the motor mount fastener retainers onto the motor mount bolt.

Figure 4:
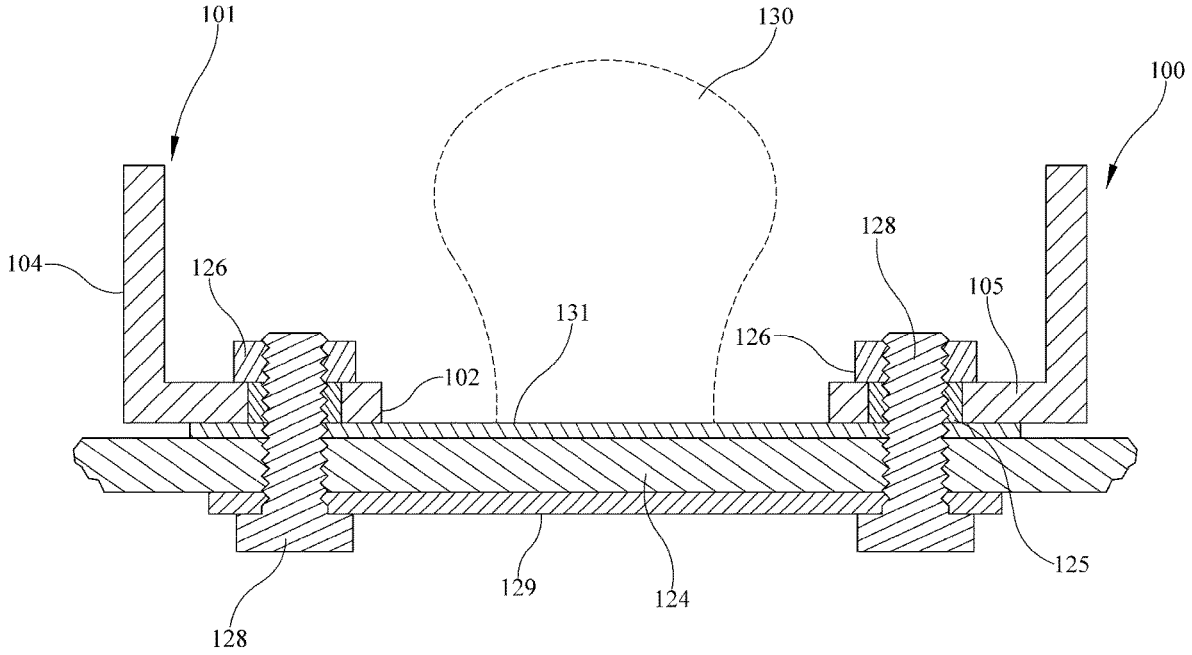
FIG. 4 shows a cross-sectional view of the presently disclosed marine outboard motor mount fastener retainer system mounted on the transom of a marine vessel.

FIG. 4 shows an upper cross-sectional view of a marine outboard motor mount fastener retainer system mounted on the transom, jack plate, or extension from the transom, 124, of a marine vessel, as shown in FIG. 3. Motor mount fasteners may each comprise a motor mount bolt 128 and a motor mount nut 125.

First motor mount fastener retainer 100 may have a first end portion 102 configured to be held about a first, or upper right, motor mount fastener or motor mount nut 125 or bolt 128. First motor mount fastener retainer 100 may have a first extension 105 extending from its first end portion 102 to its second end portion 103. First extension 105, of the first retainer 100, may be placed about motor mount fastener or motor mount nut 125 or bolt 128. For example, first motor mount fastener receiver 106 may receive upper right motor mount nut 125, as viewed in FIG. 3 and shown in FIG. 4. Second extension 105, of the second retainer 101, may be placed about motor mount fastener or motor mount nut 125 or bolt 128. For example, a motor mount fastener receiver 106, of second retainer 101, may receive upper left motor mount nut 125, as viewed in FIG. 3 and shown in FIG. 4.

The upper right motor mount bolt 128 is shown to extend through a mounting bar or plate 129, transom, jack plate, or extension from the transom 124, mounting bracket 131, and motor mount fastener retainer 100. The left motor mount bolt 128 is shown to extend through mounting bar or plate 129, transom, jack plate, or extension from the transom 124, mounting bracket 131, and motor mount fastener retainer 101. Outboard motor 130 is held to transom, jack plate, or extension from the transom 124 with mounting bracket 131.

Mounting bar or plate 129 may provide support to transom, jack plate, or extension from the transom 124 and support the head of motor mount bolt 128, or motor mount nut 125. Mounting bracket 131 may be configured to pivotally mount outboard motor 130 to transom, jack plate, or extension from the transom 124.

In at least one embodiment of the present disclosure, a portion of motor mount bolt 128 extends beyond motor mount fastener retainers 100 and 101 and provides a threaded portion for securing motor mount retainer nut 126. Motor mount retainer nuts 126 may hold motor mount fastener retainers 100 and 101 onto mounting bracket 131. For example, motor mount retainer nuts 126 may have a larger outer perimeter than a perimeter of motor mount fastener receivers 106 and 108, or washers and/or spacers may be placed between motor mount retainer nut 126 and motor mount fastener retainers 100 and 101 for securing motor mount fastener retainers 100 and 101 tightly onto mounting bracket 131.

FIGS. 5*a*-5*d* show embodiments of nut stabilizers that may be a component part of the presently disclosed marine outboard motor mount fastener retainer system. A nut stabilizer may be used to stabilize a motor mount retainer nut 126 or configured to rotationally hold the motor mount retainer nuts 126. For example, nut stabilizer 114, shown in FIG. 5*a*, may have tab 115 configured and disposed to cooperate with indent or aperture 116, in motor mount fastener retainers 100 and 101, and bendable tabs 117 that may be bent up around motor mount retainer nut 126. FIG. 5*b* shows nut stabilizer 136 that may have a retaining surface 127 that may fit about opposite sides of motor mount bolt 128 and stop its rotation. A fastener 121 may installed through nut stabilizer 136 and into indent or aperture 116, in motor mount fastener retainers 100 and 101. FIG. 5*c* shows nut stabilizer 134 having an angled slit 135 in a side thereof. Angled slit 135 is expanded upon placement onto motor mount bolt 128 and places axial force on the threads, which frictionally resists vibrational movement of nut stabilizer 134 on motor mount bolt 128. FIG. 5*d* shows nut stabilizer 138 which may comprise a wire wrapped around a plurality of motor mount retainer nuts 126.

FIGS. 6*a* and 6*b* show alternative embodiments of the presently disclosed nut stabilizers or marine outboard motor mount fastener retainers. Stabilizers 140 and 142 may have end openings, 141 and 143, for fitting with a hex nut or bolt head, such as motor mount retainer nuts 126 and/or heads of motor mount bolts 128.

Presently disclosed is a method of mounting a marine outboard motor onto a transom of a boat. A motor mount bracket is placed onto a transom, jack plate, or extension from the transom 124 of a boat or marine vessel. A plurality of motor mount bolts 128 are extended through the transom, jack plate, or extension from the transom 124, and the mounting bracket 131. A motor mount nut 125 is fastened onto each of the motor mount bolts 128 and mounting bracket 131 is secured onto the transom, jack plate, or extension from the transom 124. A first end portion 102 of a motor mount fastener retainer, 100 or 101, is placed about one of the motor mount nuts 125 or heads of the motor mount bolts 128. A second end portion 103 of the motor mount fastener retainer, 100 or 101, is placed about another one of the motor mount nuts 125 or heads of the motor mount bolts 128. The end portions 102 and 103 of motor mount fastener retainer, 100 or 101, are secured about the motor mount nuts 125 or heads of the motor mount bolts 128 and thereby prevents rotation of the motor mount nuts 125 or heads of the motor mount bolts 128 having the motor mount fastener retainer, 100 or 101, secured thereabout. Motor mount retainer nuts 126 may be secured onto motor mount bolts 128, extending through the portions of the motor mount fastener retainer, 100 or 101.

One feature or aspect of an illustrative example is believed at the time of the filing of this patent application to possibly reside broadly in a marine outboard motor mount fastener retainer comprising: a first end portion configured to be held about a first motor mount fastener; a second end portion configured to be held about a second motor mount fastener; and an extension extending from the first end portion of the retainer to the second end portion of the retainer, the extension being configured to hold the first and the second end portions of the retainer and to prevent rotation of the first motor mount fastener and the second motor mount fastener.

Another feature or aspect of an illustrative example is believed at the time of the filing of this patent application to possibly reside broadly in a marine outboard motor mount fastener retainer, wherein the motor mount fasteners each comprise a bolt and a nut, the first end portion of the retainer being configured to be held onto the bolt or nut of the first motor mount fastener and the second end portion of the retainer being configured to be held onto the bolt or nut of the second motor mount fastener.

Yet another feature or aspect of an illustrative example is believed at the time of the filing of this patent application to possibly reside broadly in a marine outboard motor mount fastener retainer, wherein a center of the first end portion of the retainer is spaced between about 6 and 10 inches from a center of the second end portion of the retainer.

Still another feature or aspect of an illustrative example is believed at the time of the filing of this patent application to possibly reside broadly in a marine outboard motor mount fastener retainer, wherein the extension is configured for attaching a boat accessory.

A further feature or aspect of an illustrative example is believed at the time of the filing of this patent application to possibly reside broadly in a marine outboard motor mount fastener retainer, wherein the extension comprises a portion having at least one aperture for attaching the boat accessory.

Another feature or aspect of an illustrative example is believed at the time of the filing of this patent application to possibly reside broadly in a marine outboard motor mount fastener retainer, wherein the extension comprises a portion configured to become gap spaced from a transom or a motor mounting bracket, upon the retainer being held onto the motor mount fasteners.

Yet another feature or aspect of an illustrative example is believed at the time of the filing of this patent application to possibly reside broadly in a marine outboard motor mount fastener retainer, wherein the portion of the extension having the at least one aperture is configured to space the aperture from a transom or a motor mounting bracket, upon the retainer being held onto the motor mount fasteners.

Still another feature or aspect of an illustrative example is believed at the time of the filing of this patent application to possibly reside broadly in a marine outboard motor mount fastener retainer system comprising a first motor mount fastener retainer and a second motor mount fastener retainer: the first motor mount fastener retainer comprising: a first end portion configured to be held about a first motor mount fastener; a second end portion configured to be held about a second motor mount fastener; and an first extension extending from the first end portion of the first retainer to the second end portion of the first retainer, the first extension being configured to hold the first and the second end portions of the first retainer and to prevent rotation of the first motor mount fastener and the second motor mount fastener; the second motor mount fastener retainer comprising: a first end portion configured to be held about a third motor mount fastener; a second end portion configured to be held about a fourth motor mount fastener; and a second extension extending from the first end portion of the second retainer to the second end portion of the second retainer, the extension being configured to hold the first and the second end portions of the second retainer and to prevent rotation of the third motor mount fastener and the fourth motor mount fastener.

A further feature or aspect of an illustrative example is believed at the time of the filing of this patent application to possibly reside broadly in a marine outboard motor mount fastener retainer system, wherein the first, the second, the third, and the fourth motor mount fasteners each comprise a bolt and a nut, each of the end portions of the first motor mount fastener retainer and the end portions of the second motor mount fastener retainer being configured to be held onto one of the bolts and nuts of the motor mount fasteners.

Another feature or aspect of an illustrative example is believed at the time of the filing of this patent application to possibly reside broadly in a marine outboard motor mount fastener retainer system further comprising motor mount retainer nuts, each of the motor mount retainer nuts being configured to fit onto one of the motor mount bolts and hold one of the end portions of one of the motor mount fastener retainers onto the motor mount bolt.

Yet another feature or aspect of an illustrative example is believed at the time of the filing of this patent application to possibly reside broadly in a marine outboard motor mount fastener retainer system further comprising motor mount retainer nut stabilizer, each of the motor mount retainer nut stabilizers being configured to rotationally hold one of the motor mount retainer nuts.

One feature or aspect of an illustrative example is believed at the time of the filing of this patent application to possibly reside broadly in a marine outboard motor mount fastener retainer system, wherein the second motor mount fastener retainer is a mirror image of the first motor mount fastener retainer.

Another feature or aspect of an illustrative example is believed at the time of the filing of this patent application to possibly reside broadly in a marine outboard motor mount fastener retainer system, wherein a center of the first end portion of each of the first retainer is spaced between about 6 and 10 inches from a center of the second end portion of the first retainer.

Yet another feature or aspect of an illustrative example is believed at the time of the filing of this patent application to possibly reside broadly in a marine outboard motor mount fastener retainer system, wherein at least one of the extension of the first retainer and the extension of the second retainer is configured for attaching a boat accessory.

Still another feature or aspect of an illustrative example is believed at the time of the filing of this patent application to possibly reside broadly in a marine outboard motor mount fastener retainer system, wherein the at least one extension configured for attaching a boat accessory comprises a portion having at least one aperture.

A further feature or aspect of an illustrative example is believed at the time of the filing of this patent application to possibly reside broadly in a marine outboard motor mount fastener retainer system, wherein the at least one extension configured for attaching a boat accessory comprises a portion configured to become gap spaced from a transom or a motor mounting bracket, upon the retainer being held onto the motor mount fasteners.

Another feature or aspect of an illustrative example is believed at the time of the filing of this patent application to possibly reside broadly in a marine outboard motor mount fastener retainer system, wherein the portion of the extension comprising the at least one aperture is configured to space the aperture from a transom or a motor mounting bracket, upon the retainer being held onto the motor mount fasteners.

Yet another feature or aspect of an illustrative example is believed at the time of the filing of this patent application to possibly reside broadly in a method of mounting a marine outboard motor onto a transom of a boat comprising the steps of: placing a motor mounting bracket onto a transom of a boat; extending a plurality of motor mount bolts through the transom and the mounting bracket; fastening a motor mount nut onto each of the motor mount bolts and securing the mounting bracket onto the transom; placing a first end portion of a motor mount fastener retainer about one of the motor mount nuts or heads of the motor mount bolts; placing a second end portion of the motor mount fastener retainer about another one of the motor mount nuts or heads of the motor mount bolts; and securing the end portions of the motor mount fastener retainer about the motor mount nuts or heads of the motor mount bolts and thereby preventing rotation of the motor mount nuts or heads of the motor mount bolts having the motor mount fastener retainer secured thereabout.

Still another feature or aspect of an illustrative example is believed at the time of the filing of this patent application to possibly reside broadly in a method of mounting a marine outboard motor onto a transom of a boat, wherein the motor mount fastener retainer is secured about the motor mount nuts and the method further comprises securing motor mount retainer nuts onto the motor mount bolts extending through the portions of the motor mount fastener retainer.

| Nomenclature | |
|---|---|
| motor mount fastener retainer | 100, 101 |
| first end portion of the motor mount fastener retainer | 102 |
| second end portion of the motor mount fastener retainer | 103 |
| flange | 104 |
| extension | 105 |
| first motor mount fastener receiver | 106 |
| second motor fastener receiver | 108 |
| aperture | 110 |
| angular or nonlinear wall of extension | 112 |
| nut stabilizer | 114, 134, 136, 138 |
| tab | 115 |
| aperture or indentation | 116 |
| bendable tab | 117 |
| hull of marine vessel | 120 |
| fastener | 121 |
| transom/jack plate/extension from transom | 124 |
| motor mount nut | 125 |
| motor mount retainer nut | 126 |
| retaining surface | 127 |
| motor mount bolt | 128 |
| mounting bar or plate | 129 |
| boat motor | 130 |
| mounting bracket | 131 |
| tension nut | 134 |
| slit | 135 |
| wire | 138 |
| vertical space between a center of an upper motor mount fastener receiver and a center of a lower motor mount fastener receiver | a |
| horizontal offset between a center of an upper motor mount fastener receiver and a center of a lower motor mount fastener receiver | b |

The invention claimed is:

1. A marine outboard motor mount fastener retainer comprising:

a first end portion having a first opening for receiving a first bolt of a first motor mount fastener and to prevent rotation of a first nut on the first bolt of the first motor mount fastener;

a second end portion having a second opening for receiving a second bolt of a second motor mount fastener and prevent rotation of a second nut on the second bolt of the second mount fastener;

an extension extending from the first end portion of the retainer to the second end portion of the retainer, the extension being configured to hold the first and the second end portions of the retainer and to prevent rotation of the nuts on the motor mount fasteners;

motor mount retainer nuts, each of the motor mount retainer nuts being configured to fit onto one of the motor mount bolts and hold one of the end portions of the motor mount fastener retainer onto the motor mount bolts; and wherein the extension has a wall extending inwardly between the first opening and the second opening for fitting about or around outwardly extending portions of an outboard motor, an outboard motor mount, a transom, a jack plate, or an extension from the transom.

2. The marine outboard motor mount fastener retainer of claim 1, wherein the first opening in the first end portion of the retainer is spaced between about 6 and 10 inches from the second opening in the second end portion of the retainer.

3. The marine outboard motor mount fastener retainer of claim 1, wherein the extension is configured for attaching a boat accessory.

4. The marine outboard motor mount fastener retainer of claim 3, wherein the extension comprises a portion having at least one aperture for attaching the boat accessory.

5. The marine outboard motor mount fastener retainer of claim 3, wherein the extension comprises a portion configured to become gap spaced from a transom, jack plate, extension from the transom, or a motor mounting bracket, upon the retainer being held onto the motor mount fasteners.

6. The marine outboard motor mount fastener retainer of claim 4, wherein the portion of the extension having the at least one aperture is configured to space the aperture from the transom, jack plate, extension from the transom, or the motor mounting bracket, upon the retainer being held onto the motor mount fasteners.

7. A marine outboard motor mount fastener retainer system comprising a first motor mount fastener retainer and a second motor mount fastener retainer:

the first motor mount fastener retainer comprising:

a first end portion having a first opening configured to receive a first bolt of a first motor mount fastener and to prevent rotation of a first nut on the first bolt of the first motor mount fastener;

a second end portion having a second opening configured to receive a second bolt of a second motor mount fastener and to prevent rotation of a second nut on the second bolt of the second mount fastener;

a first extension extending from the first end portion of the first retainer to the second end portion of the first retainer, the first extension being configured to hold the first and the second end portions of the first retainer and to prevent rotation of the first nut on the first motor mount fastener and the second nut on the second motor mount fastener; and wherein the first extension has a wall extending inwardly between the first opening and the second opening for fitting about or around outwardly extending portions of an outboard motor, an outboard motor mount, a transom, a jack plate, or an extension from the transom;

the second motor mount fastener retainer comprising:

a first end portion having a third opening configured to receive a third bolt of a third motor mount fastener and to prevent rotation of a third nut on the third bolt of the third motor mount fastener;

a second end portion having a fourth opening configured to receive a fourth bolt of a fourth motor mount fastener and to prevent rotation of a fourth nut on the fourth bolt of the fourth motor mount fastener;

a second extension extending from the first end portion of the second retainer to the second end portion of the second retainer, the second extension being configured to hold the first and the second end portions of the second retainer and to prevent rotation of the third nut on the third motor mount fastener and the fourth nut on the fourth motor mount fastener;

motor mount retainer nuts, each of the motor mount retainer nuts being configured to fit onto one of the motor mount bolts and hold one of the end portions of one of the motor mount fastener retainers onto the motor mount bolt; and wherein the second extension has a wall extending inwardly between the third opening and the fourth opening for fitting about or around outwardly extending portions of the outboard motor, outboard motor mount, transom, jack plate, or the extension from the transom.

8. The marine outboard motor mount fastener retainer system of claim 7 further comprising motor mount retainer nut stabilizers, each of the motor mount retainer nut stabilizers being configured to rotationally hold one of the motor mount retainer nuts.

9. The marine outboard motor mount fastener retainer system of claim 7, wherein the second motor mount fastener retainer is a mirror image of the first motor mount fastener retainer.

10. The marine outboard motor mount fastener retainer system of claim 7, wherein the first opening in the first end portion of the first retainer is spaced between about 6 and 10 inches from the second opening in the second end portion of the first retainer.

11. The marine outboard motor mount fastener retainer system of claim 7, wherein at least one of the extension of the first retainer and the extension of the second retainer is configured for attaching a boat accessory.

12. The marine outboard motor mount fastener retainer system of claim 11, wherein the at least one extension configured for attaching a boat accessory comprises a portion having at least one aperture.

13. The marine outboard motor mount fastener retainer system of claim 11, wherein the at least one extension configured for attaching a boat accessory comprises a portion configured to become gap spaced from a transom, jack plate, extension from the transom, or a motor mounting bracket, upon the retainer being held onto the motor mount fasteners.

14. The marine outboard motor mount fastener retainer system of claim 12, wherein the portion of the extension comprising the at least one aperture is configured to space the aperture from a transom, jack plate, extension from the transom, or a motor mounting bracket, upon the retainer being held onto the motor mount fasteners.

15. A method of mounting a marine outboard motor onto a transom of a boat comprising the steps of:

placing a motor mounting bracket onto a transom of a boat;

extending a plurality of motor mount bolts through the transom and the mounting bracket;

fastening a motor mount nut onto each of the motor mount bolts and securing the mounting bracket onto the transom;

placing a first opening in a first end portion of a motor mount fastener retainer about one of the motor mount bolts and adjacent one of the motor mount nuts, upon the motor mount nut being fastened onto one of the motor mount bolts;

placing a second opening in a second end portion of the motor mount fastener retainer about another one of the motor mount bolts and adjacent one of the motor mount nuts upon the motor mount nut being fastened onto one of the motor mount bolts;

placing a wall of an extension, the wall extending inwardly between the first opening and the second opening, and fitting the extension about or around outwardly extending portions of an outboard motor, outboard motor mount, transom, jack plate, or extension from the transom; and securing the end portions of the motor mount fastener retainer adjacent the motor mount nuts and thereby preventing rotation of the motor mount nuts having the motor mount fastener retainer secured adjacently thereto.

16. The method of mounting a marine outboard motor onto a transom of a boat of claim 15, wherein the step of securing the end portions of the motor mount fastener retainer adjacent the motor mount nuts comprises securing motor mount retainer nuts onto the motor mount bolts extending through the portions of the motor mount fastener retainer.

* * * * *